United States Patent [19]

Boucher et al.

[11] Patent Number: 4,833,737

[45] Date of Patent: May 30, 1989

[54] LOCKING MEANS

[75] Inventors: Richard A. Boucher, Ashburnham; Randy L. Abrams, Leominster, both of Mass.

[73] Assignee: Sanitoy, Inc., Fitchburg, Mass.

[21] Appl. No.: 113,903

[22] Filed: Oct. 29, 1987

[51] Int. Cl.[4] ..... A47R 13/24

[52] U.S. Cl. ..... 4/253; 292/67; 292/266

[58] Field of Search ..... 4/253; 292/67, 152, 292/266, 273, 277; 297/305; 312/333

[56] References Cited

U.S. PATENT DOCUMENTS

| | | | |
|---|---|---|---|
| 320,551 | 6/1885 | Gilmore | 292/305 |
| 437,982 | 10/1890 | Diefenderfer | 292/305 |
| 1,148,877 | 8/1915 | Walter | 292/277 |
| 1,851,701 | 3/1932 | Goll | 292/305 |
| 1,954,739 | 4/1934 | Lyons | 292/305 |
| 2,651,053 | 9/1953 | Rowe et al. | 4/253 |
| 2,724,609 | 11/1955 | Donnelly | 292/266 |
| 3,056,972 | 10/1962 | Miller | 4/253 |
| 3,100,122 | 8/1963 | Knapp | 292/266 |
| 3,431,004 | 3/1969 | Schell | 4/253 |

*Primary Examiner*—Charles E. Phillips

*Attorney, Agent, or Firm*—John G. Gilfillan; Elliot M. Olstein; Jeremiah G. Murray

[57] ABSTRACT

A locking apparatus for securing adjacent articulated members such as a toilet seat and lid mounted on a bowl. Included is a plate for mounting the apparatus to the bowl and a locking arm movable with respect to said plate to a position where the leg of the locking arm overlies the lid.

3 Claims, 4 Drawing Sheets

LOCKING MEANS

BACKGROUND OF THE INVENTION

This invention relates to locking means and, in particular locking means for securing adjacent articulated members such as to preclude or limit relative movement between them. Typical examples of such articulated members are a toilet bowl and the lid of the toilet seat, as well as a trash can having a hinged lid.

Who among us who have been fortunate enough to have small children, or even pets, has not experienced splashing noises from the bathroom which, upon investigation have been found to be the result of playful antics. In the child's mind the toilet bowl has become a lake for sailing his toy boat, a test site for a new submersible toy or even worse, a bathtub of the new puppy. Although such happenings are often the source of fond memories, the fact remains that at best they are inconvenient and at worst can sometimes result in accidental drowning, costly plumbing repairs and contact with sewage.

Similarly, how often to people find spilled waste as a result of children or pets overturning waste containers. If there was a way of securing the container lid when the container is not in use, the spillage could be avoided even if the container is overturned.

Thus there appears to be a need for a locking means to secure articulated members such as hinged lids and the like. Such a locking means should be easy to operate for an adult, inexpensive to manufacture and simple to install.

SUMMARY OF THE INVENTION

It is an object of the present invention, therefore, to provide a locking means for articulated members such as toilet lids and waste container lids.

It is a further object of the present invention to provide a locking means for articulated members which may be installed subsequent to the original manufacture of the articulated members.

An additional object of the present invention is to provide a locking means for articulated members which is inexpensive to manufacture, simple to assemble and install, and easy to operate for people other than small children.

These objects and others are enumerated are achieved by the locking means of the present invention, one embodiment of which may include a base element for securing a first articulated member, a locking arm rotatably and slidably received through the base element as so to be selectively rotatable and slidable between positions limiting the articulation of the first articulated member with respect to a second articulated member and a position permitting articulation of the members without limitation.

BRIEF DESCRIPTION OF THE DRAWINGS

A more complete understanding of the present invention may be had from the following detailed description, particularly when read in the light of the accompanying drawings, wherein.

DETAILED DESCRIPTION

Figure 1:
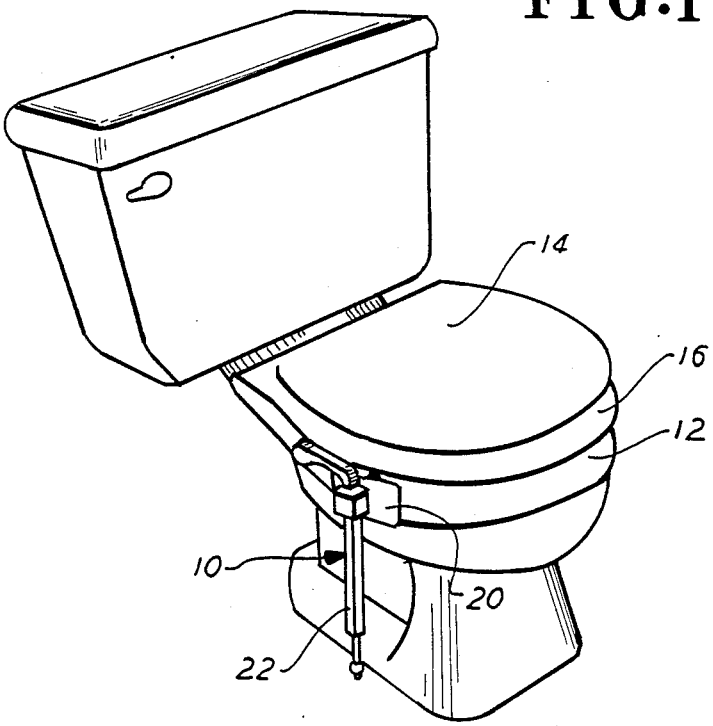
FIG. 1 is a perspective view of a locking means according to the present invention mounted on a typical toilet with the locking arm being positioned so as not to limit the raising of the toilet seat lid.

Referring now to the drawings, there is shown in FIG. 1 a locking means structured in accordance with the present invention and designated generally by the reference numeral 10.

Locking means 10 is secured to the outside surface of a toilet bowl 12 and, as shown is positioned so as not to limit rotation of either the toilet lid 14 or toilet seat 16 with respect to bowl 12. In this regard the lid 14 and seat 16 are secured to bowl 12 through the use of typical hinges and the bowl 12, lid 14 and seat 16 thus define adjacent articulated members.

Locking means 10 can be seen to include a base element 20 and a locking arm 22. As is discussed below in detail, locking arm 22 can be rotated from a position such as that shown in FIG. 1 where it does not limit rotation of lid 14 and seat 16 with respect to bowl 12, and a position such as that shown in FIG. 2 where it precludes rotation of lid 14 and seat 16 with respect to bowl 12. The technique of operating the locking means 10, discussed below in detail, is quite simple for people other than young children so that this locking means, effectively, is a means for precluding young children or possibly pets from gaining entry to the interior of the bowl.

Figure 3:
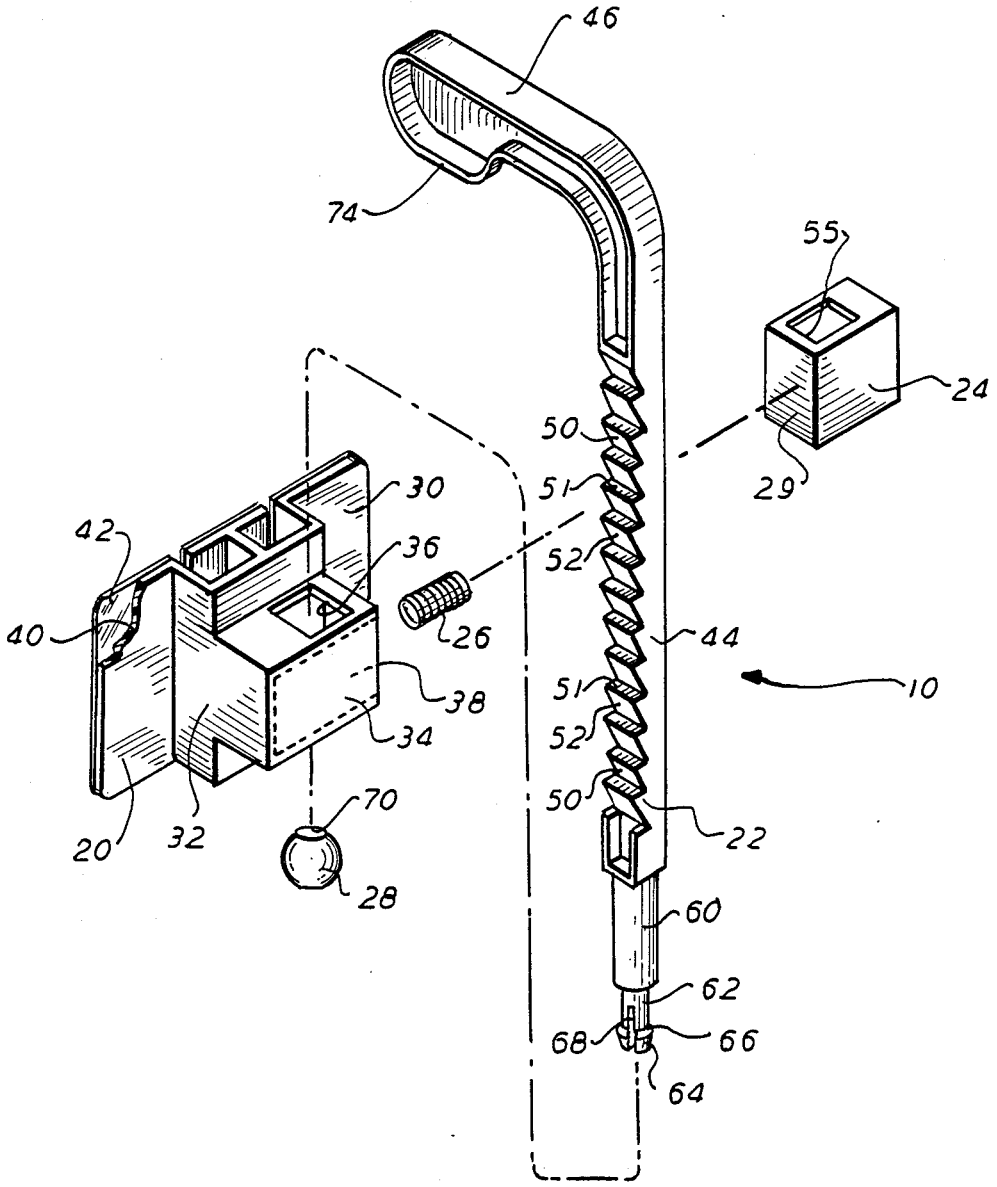
FIG. 3 is an exploded isometric view of a locking means according to the present invention.

Referring now to FIG. 3, there is shown an exploded perspective of locking means 10 which can be seen to include base element 20, locking arm 22, a detent plunger 24 which cooperates with spring means 26 as is discussed below and a locking ball 28 which slides over one end of locking arm 22 to preclude passage of the end of locking arm 22 through base element 20 once assembled.

Base element 20 comprises a mounting plate 30 which although shown in three sections, may be a single plate. Secured to plate 30 is a body 32 having a stepped portion 34. Formed through stepped portion 34 is a first rectangular opening 36 which permits longitudinal passage of locking arm 22 therethrough. In this regard although first opening 36 is shown to be rectangular in shape, it may be configured in any non-circular configuration to correspond generally to the cross-section of the locking arm so as to preclude non-desired rotation therebetween.

Also formed in stepped portion 34 is a second opening 38, the axis of which is generally perpendicular to the axis of first opening 36. Opening 38 accommodates the insertion therein of spring 26 and detent plunger 24. Thus, when fully assembled, spring 26 is compressed against the inner surface of stepped portion 34 as defined by second opening 38 and bears against inner surface 29 of detent plunger 24 tending to urge detent plunger 24 out of second opening 38.

Broadcast on the surface of mounting plate 30 is a coating of adhesive material 40 which permits the base element 20 to be secured to a surface such as the outer surface of toilet bowl 12. Prior to mounting on a surface, the adhesive material 40 is covered by a layer of release paper 42 which is removable as desired.

Locking arm 22 is a generally L-shaped member having a first leg portion 44 and a second leg portion 46 the axes of which are generally perpendicular. In the preferred embodiment of the invention, locking arm 22 is a unitary member manufactured by molding. However other techniques of manufacture can be utilized. First leg portion 44 is generally rectangular in cross-section and provided with a plurality of teeth 50 on one surface. Each tooth 50 is defined by a first surface 51 the plane of which is normal to the longitudinal axis of first leg portion 44 and a second surface 52 which is angled acutely with respect to the longitudinal axis of first leg portion 44.

Formed through detent plunger 24 is a rectangular opening 55 which is sized to permit the passage of the first leg portion 44 of locking arm 22 therethrough. To assemble locking arm 22 within base element 20, spring 26 and detent plunger 24 are positioned within second opening 38 of the stepped portion 34. The detent plunger is pushed into opening 38 against the force of spring 26 until opening 55 in the plunger is aligned with first opening 36 in the stepped portion 34. At this point first leg portion 44 is passed through openings 36 and 55 with its teeth 50 facing spring 26. Once the toothed surface passes into detent plunger 24, the plunger may be released such that the edges of opening 55 engage the tooth surface. Continued advance of first leg portion 44 causes surfaces 52 to cam detent plunger inwardly against the force of spring 26. However, because the planes of surfaces 51 are normal to the longitudinal axis of first leg portion 44, any attempt to move locking arm 22 upwardly as seen in FIG. 3 will permit detent plunger 24 to be displaced outwardly by the force of spring 26 thereby causing surface 51 of the proximate tooth 50 to engage the inner surface of plunger 24 thereby locking the arm against further upward movement.

The lower portion of first leg portion 44, i.e. the portion below the toothed portion as seen in FIG. 3, includes the first circular element 60, a second circular element 62 which is below and of a smaller diameter than first circular element 60, The lower portion of first leg portion 44, i.e. the portion below the toothed portion as seen in FIG. 3, includes a first circular element 60, a second circular element 62 which is below and of a smaller diameter than first circular element 60, and a frusto-conical element 64, the base of which copperates with second circular element 62 to define a radially extending shoulder 66. Formed to extend longitudinally through the center of frusto-conical element 64 and second circular element 62 is a slit 68. In this regard, slit 68 is of a width and depth which permits the separated ends to be deflected inwardly to permit the mounting thereon of locking ball 28.

Figure 4:
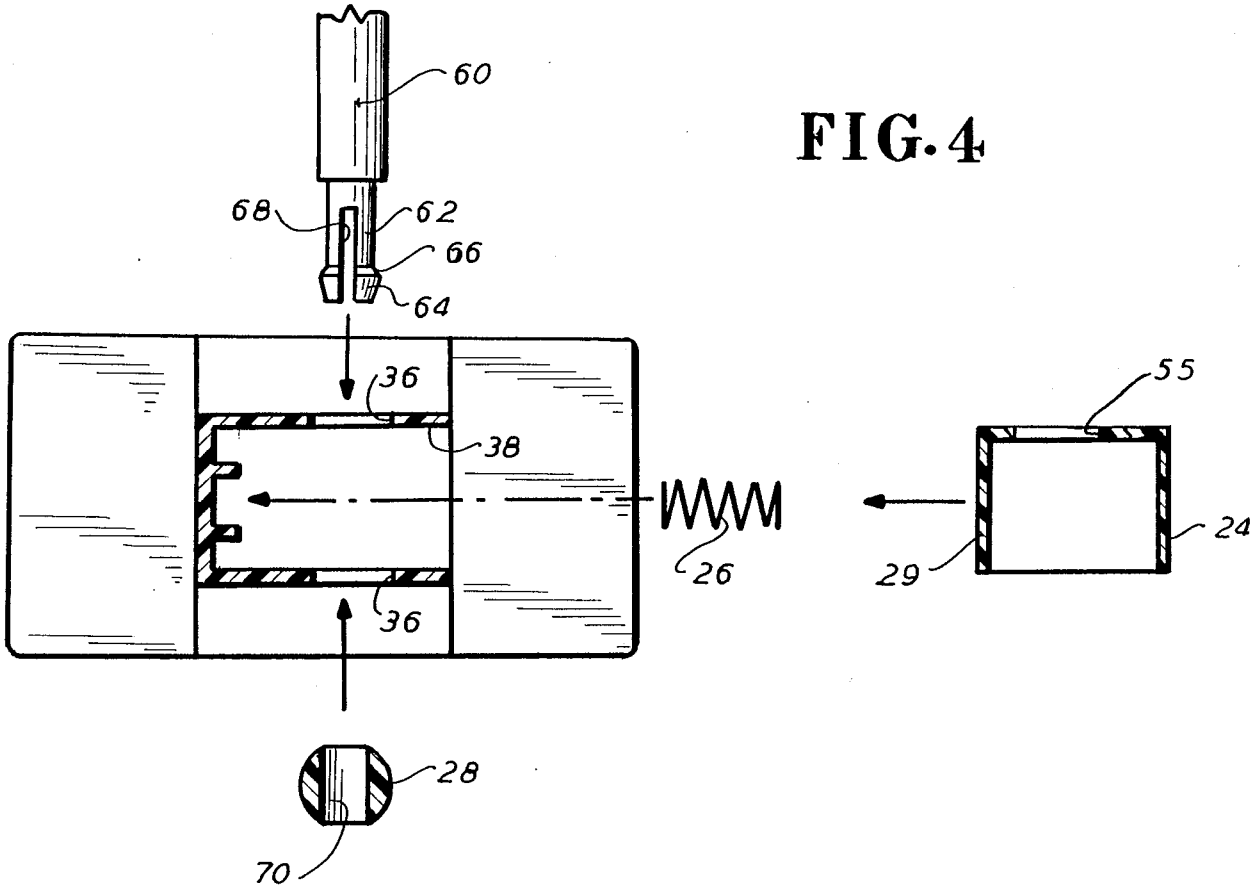
FIG. 4 is a view, partly in cross-section, of the base element, spring loaded detent plunger and locking arm securing means of the present invention.

More specifically, with particular reference to FIG. 4, locking ball 28 is a generally spherical member having a bore 70 formed therethrough. The diameter of bore 70 is slightly smaller than the diameter of the base of frusto-conical element 64 and slightly larger than the diameter of second circular element 62. Thus, with the first leg portion 44 of locking arm received through openings 36 and 55, locking ball 28 may be pushed over frusto-conical element 64 and received on second circular element 62 so as to preclude removal of locking arm 22, the diameter of locking ball 28 being greater than the size of openings 36 and 55.

The second leg portion 46 of locking arm 22 is provided with an extended lower surface 74 which is intended to contact the upper surface of lid 14 to preclude rotation with respect to bowl 12.

The locking means 10 may be assembled prior to shipment. Assembly is quite simple. With spring 26 and detent plug positioned within second opening 38 such that openings 36 and 55 are in alignment, the first leg portion 44 of locking arm 22 is passed through openings 36 and 55 and locking ball 28 is passed over frusto-conical element 64 and locked on second circular element 62. The locking means so assembled may be packaged and shipped.

In order to use locking means 10, the release paper 42 is removed from plates 30 to expose adhesive 40. The adhesed surface of base element 20 is then pressed against the surface of bowl 12 at the desired location, i.e. adjacent its upper edge, to secure the base element to the bowl.

Figure 2:
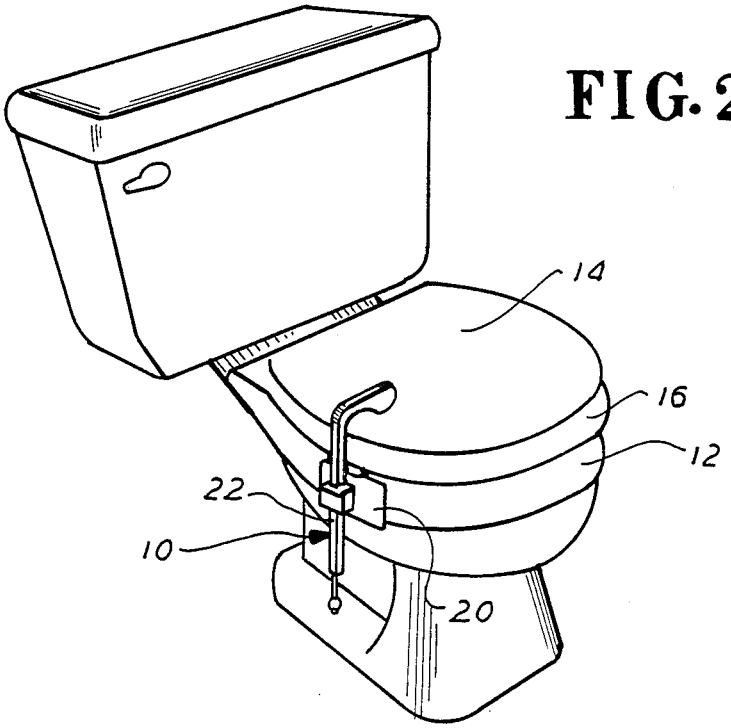
FIG. 2 is a view similar to FIG. 1 but showing the locking arm positioned to preclude opening of the toilet seat lid.
Figure 5:
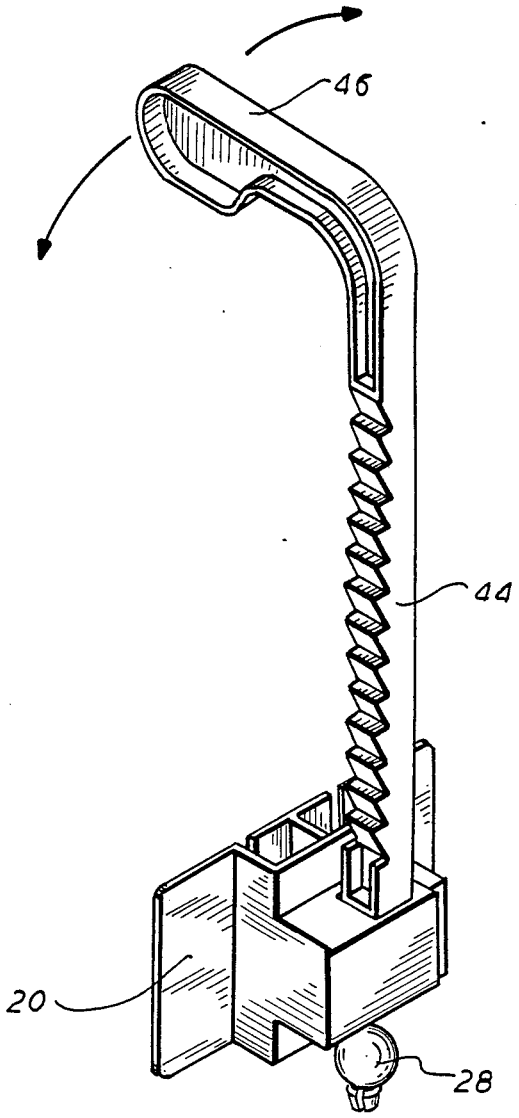
FIG. 5 is an isometric view of a locking means according to the present invention showing the locking arm in position for rotational movement between locking and unlocking positions.

With the device so assembled and positioned, and with first circular element 60 positioned within openings 36 and 55 (FIG. 5) the locking arm 22 may be rotated between locking and unlocking positions (FIGS. 2 and 1). With the arm in the locking rotational position, it may be passed downwardly through openings 36 and 55 until the detent plunger cooperates with teeth 50 to lock the arm in place.

The parts of locking means 10 may be manufactured from any of many known materials, e.g. plastic, by any of kany known manufacturing techniques, e.g. molding. Moreover, many modifications and variations may be made to the present invention without departing from the spirit and scope thereof.

I claim:

1. A lock comprising:

a base element having means for securing said base element to a first articulated member;

a locking arm slidably mounted on said base element to permit linear and rotatable motion of said arm with respect to said base element;

said locking arm including a rigid locking member extending from one and thereof;

a locking means mounted on said base element for releasably locking said arm, when said locking member is oriented in a first angular position, to prevent linear movement of said arm in a first direction with respect to said base element and to prevent rotation of said arm with respect to said base element while permitting slidable, linear movement of said arm in a second direction opposite to said first direction;

said locking means including means for permitting selective manual release of said locking means to permit linear movement of said arm in said first direction during manual release of said locking means;

said locking means permitting linear slidable movement of said arm in said first and second directions and for preventing rotation of said arm when said locking member is oriented to an angular position different then said first position;

rotating means mounted to said locking arm for permitting rotation of said locking arm in said base element when said arm is moved to a position wherein said rotating means is contained in said base element;

said locking means including a detent resiliently biased into engagement with said locking arm and means for permitting selective, manual movement of said detent out of engagement with said locking arm;

said arm including a saw tooth surface on one side thereof having means for preventing movement of said arm in said first direction and permitting movement of said arm in said second direction when said detent is biased into engagement with said saw tooth; and said locking arm being mounted in an opening in said locking means and having a non-circular cross-section, and wherein said locking means has an opening having a non-circular cross-section substantially the same as the cross-section of said locking arm whereby rotation of said locking arm in said base element is prevented when said locking arm is contained in said opening.

2. A lock arm according to claim 1 wherein said rotating means has a cross-sectional shape that permits rotation of said arm when said rotating means is contained in said opening.

3. Locking means for selectively limiting and permitting the articulation of adjacent articulated members comprising:

a base element for securing to a first articulated member;

a locking arm slidably received through said base element, said locking arm being longitudinally slidable through and rotatable within said base element;

said locking arm being selectively rotatable and slidable through said base element between positions limiting the articulation of said adjacent articulated members and permitting the articulation of said adjacent articulated members without limitation;

a first opening formed in said base member, said first opening for receiving said locking arm slidably and rotatably therethrough, and a second opening formed in said base member, said second opening in communication with said first opening and further including detent means disposed through said second opening, said detent means for selectively precluding longitudinal sliding and rotation of said locking arm within said base element; and the cross-sectional configuration of said locking arm being generally rectangular and further including one portion formed adjacent one end thereof having a generally circular cross-section, said first opening in said base member having a generally rectangular cross-sectional configuration corresponding to the rectangular configuration of said locking arm, whereby said locking arm is rotatable within said element only when said portion of said locking arm having a circular cross-section is positioned within said first opening in said base element.

* * * * *